United States Patent [19]

Jones et al.

[11] Patent Number: 4,751,972

[45] Date of Patent: Jun. 21, 1988

[54] REVOLVING CUTTERS FOR ROCK BITS

[75] Inventors: Kenneth W. Jones, Kingwood; George Fyfe, Houston, both of Tex.

[73] Assignee: Smith International, Inc., Newport Beach, Calif.

[21] Appl. No.: 39,344

[22] Filed: Apr. 15, 1987

Related U.S. Application Data

[63] Continuation-in-part of Ser. No. 839,434, Mar. 13, 1986, abandoned.

[51] Int. Cl.[4] ..... E21B 10/08; E21B 10/12; E21B 10/50

[52] U.S. Cl. ..... 175/329; 175/336; 175/350; 175/355; 175/373

[58] Field of Search ..... 175/329, 330, 331, 332, 175/333, 334, 335, 336, 337, 341, 348, 350, 355, 361, 363, 364, 373

[56] References Cited

U.S. PATENT DOCUMENTS

| | | | |
|---|---|---|---|
| 223,230 | 1/1880 | Jenkins | 175/363 |
| 1,533,286 | 4/1925 | Wickersham . | |
| 3,695,370 | 10/1972 | Jones | 175/329 X |
| 3,830,321 | 8/1974 | McKenry | 175/332 |
| 3,862,665 | 1/1975 | Wallace | 175/336 |
| 4,010,808 | 3/1977 | Youngblood | 175/334 |
| 4,203,496 | 5/1980 | Baker, III et al. | 175/329 |
| 4,253,533 | 3/1981 | Baker, III | 175/329 |
| 4,256,191 | 3/1981 | Jones | 175/93 |
| 4,298,080 | 11/1981 | Hignett | 175/373 |
| 4,323,130 | 4/1982 | Dennis | 175/329 |
| 4,545,441 | 10/1985 | Williamson | 175/329 |
| 4,553,615 | 11/1985 | Grainger | 175/329 |
| 4,610,317 | 9/1986 | England et al. | 175/331 |

*Primary Examiner*—George A. Suchfield
*Attorney, Agent, or Firm*—Robert G. Upton

[57] ABSTRACT

A mechanism is disclosed for rock bits whereby cutting elements, rotatably mounted to fixtures with journals, are constantly forced to rotate or precess by the interaction of the earth formation and the cutter. The cutters are fixed in skewed or offset positions on a cutting face of a rotary drill bit head. These cutting elements act as drag or shear cutters when they are operated in an earth formation.

52 Claims, 7 Drawing Sheets

FIG. 1
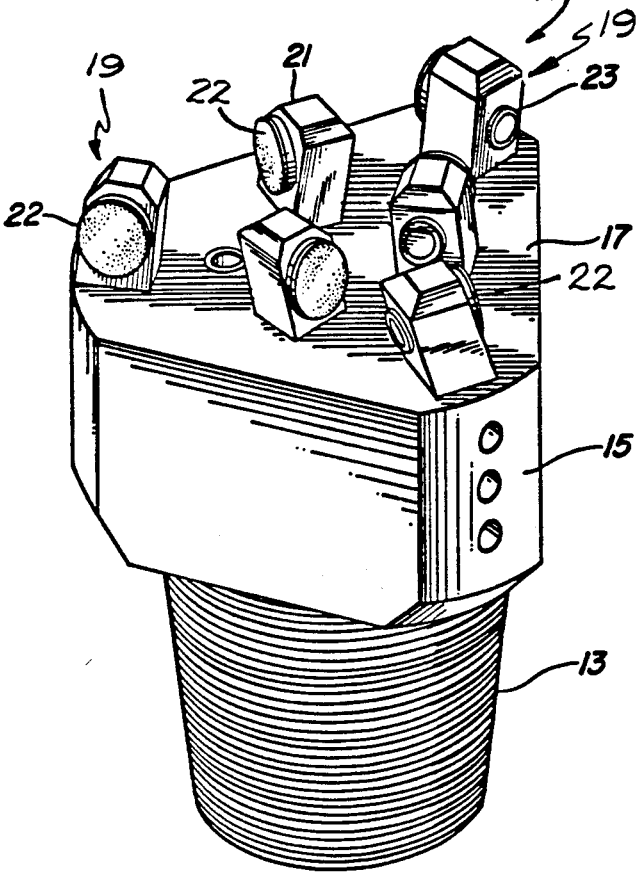
FIG. 2
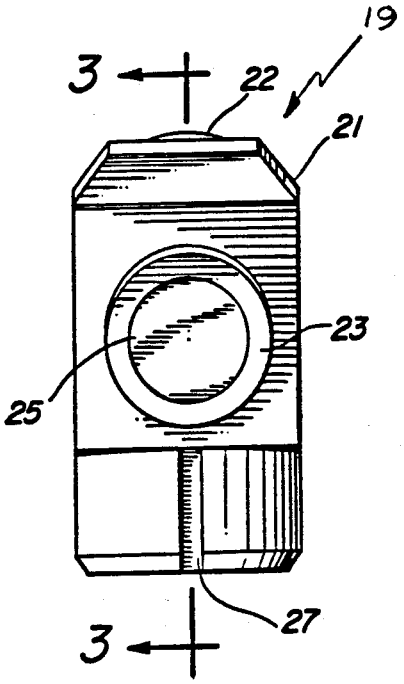
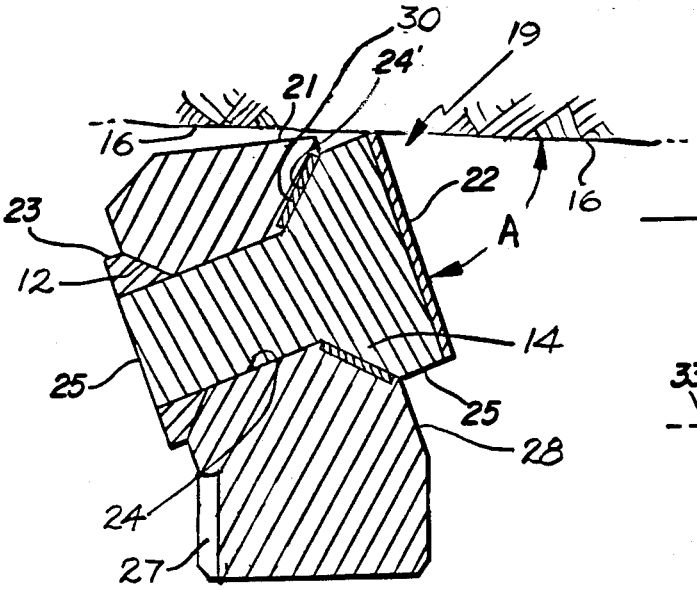
FIG. 3
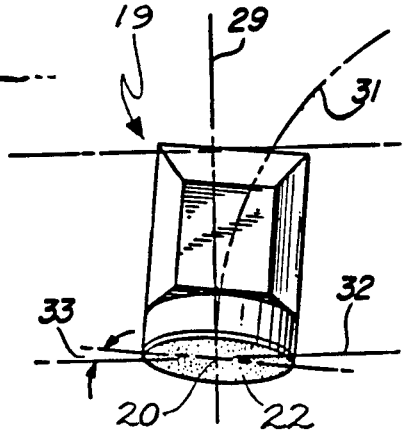
FIG. 4

REVOLVING CUTTERS FOR ROCK BITS

CROSS-REFERENCE TO RELATED APPLICATION

This application is a continuation-in-part of a co-pending application, Ser. No. 839,434, filed Mar. 13, 1986, abandoned.

BACKGROUND OF THE INVENTION

1. Field of the Invention

This invention relates to drag type rotary drill bits. More particularly, it relates to drag type rotary drill bits having cutters mounted to a cutting end of the drill bit, each of the cutters being rotatably secured to fixtures extending from the cutting end of the rotary drill bit.

2. Description of the Prior Art

There are a number of issued patents that relate to drag type rock bits as well as rock bits that are combination drag bits and rotary cone bits.

A patent application, No. 85-27893, has been filed in Great Britain on Nov. 12, 1975 and was published on May 21, 1986. The Publication No. is 2,167,107. This application was published after the filing date of the co-pending application, Ser. No. 839,434, and, of course, before the present continuation-in-part.

The British application relies on the interaction between a cutter disc and a borehole sidewall. As the bit is driven deeper into the borehole, the downward force rotates the disc cutters independent of the rotary motion of the bit. A ratchet and pawl mechanism assures a one direction rotation of the cutter wheels.

Another example of a drag bit is disclosed in U.S. Pat. No. 4,253,533, assigned to the same assignee as the present invention. This patent teaches a diamond studded insert drag bit having a multiplicity of individual diamond insert cutter blanks fixedly inserted in the face of the bit. The diamond insert blanks are strategically positioned to maximize penetration of the bit in a borehole. The bit further includes one or more wear pads adjacent the multiplicity of diamond insert cutter blanks, the wear pads serving to channel the flow of drilling fluid or "mud" emanating from fluid passages formed in the face of the bit. The wear pads seal off a portion of the borehole bottom, thereby directing hydraulic fluid across the face and over each of the strategically positioned diamond cutter blanks. The diamond cutter blanks continuously engage the borehole bottom with the same part of their circumference.

U.S. Pat. No. 4,203,496, also assigned to the same assignee as the present invention, discloses a rotary drill bit having a main body rotating about a main axis. The bit body includes a journal pin extending downwardly therefrom, with the journal forming a second axis disposed at an angle with respect to the main axis. The journal pin has a cutter rotatably mounted thereon with the cutter having a spherical outer surface which has a plurality of inner rows of tungsten carbide mounted thereon. The gage row of the cutter is also formed on the peripheral outer surface and defines a plane intersecting the intersection of the main and second axes. The cutter gage row is formed by a plurality of inserts having synthetic diamond cutting surfaces which are facing downwardly toward the apex of the cutter in order to scrape the sides of the borehole during the downwardly traveling portion of the gage insert travel cycle. The gage row diamond inserts cut the gage of the borehole during a portion of each revolution of the rotating cone as the bit body is rotated in the borehole.

Yet another U.S. Pat. No. 4,256,191, teaches a hybrid rock bit which features an independently driven cylindrical or disc shaped rotating cutter having a multiplicity of cutter inserts mounted therein. As the body of the rock bit rotates in a borehole, the cutter cone rotatably attached thereto is independently driven by the hydraulic pressure of the fluid pumped through the center of the drill pipe. The pressurized mud is pumped through the journal and the cone, causing it to rotate independently of the drill string. The mud or fluid then passes through the cone to the outside of the rock bit body. The rotating cylindrical cutter is driven to rotate around an axis that is perpendicular to the longitudinal axis of the drill string. The rotating disc shaped cutter is driven to rotate around an axis that is skewed from the longitudinal axis of the drill string.

Another U.S. Pat. No. 3,695,370, like the 4,256,191 patent, teaches the use of an independently driven cutting element. The cylindrical grinding wheel type cutter is located on the plane of the longitudinal axis of the drill string, its axis of rotating being perpendicular to the rotational axis of the drill string. This patent claims to be an improvement over disc-type bits which are driven as the result of the drill string rotation of the bit body.

U.S. Pat. No. 1,533,286 teaches a disc-type bit wherein disc cutters are mounted to rotate about a shaft that is slightly skewed from the perpendicular to the axis of bit rotation.

U.S. Pat. No. 4,298,080 teaches the use of twin disc cutter assemblies wherein a plurality of such assemblies are on the head of the drill tool with their axis of rotation being aligned radially from the axis of rotation of the drill tool head.

U.S. Pat. No. 4,553,615 teaches the use of rotatable cutting elements in a rotary drag bit wherein the cutting force of the elements comprise an agglomerate of diamond particles.

All these prior art drill bits have failed to provide a relatively inexpensive drag bit with long lasting cutters that is not susceptible to early failure as the result of overheating or that prevent the balling of the cutters and the consequent reduction in the penetration rate.

SUMMARY OF THE INVENTION

It is an object of this invention to provide a practical and inexpensive means to prolong the life of synthetic diamond and other hard cutting faces by limiting the cutting time of each segment against a borehole bottom.

Another object of this invention is to provide a means to prevent "balling" of the bit (buildup of debris adjacent the cutting face of the cutting segment).

These and other objects of the invention are accomplished by skewing the face of a rotatable cutting disc insert at an offset angle to the radii from the axis of rotation of the rotary drill head. The cutting elements are rotatably mounted to a saddle, or insert base. Rotation of the bit will cause the cutting elements to slowly precess as they contact the borehole formation. This limits the exposure of the cutting discs, limiting the heat buildup that is particularly damaging.

To improve heat dissipation when using diamond cutting elements, a plurality of diamond inserts or natural diamond particles are embedded in the cutting face of a disc, the disc being rotatably secured within a saddle or support structure. As the bit body is rotated by the rotary table, downhole motor or any other prime mover connected to a drill string and drill bit, the cutter discs are caused to rotate due to the skewed angle of the cutter journal bearing rotatively disposed within the saddle with respect to the radii from the axis of rotation of the drill string. Each of the multiplicity of cutter segments, equidistantly or randomly spaced as required around a disc, are exposed as the cutter disc slowly rotates. The cutters rotate in a predictable direction because of the tangential force exerted on the skewed cutters. Since fluid nozzles are fixed in the bit body, fluid is directed toward the borehole bottom and directed on the cutters. As the cutters rotate, the fluid washes and cools the synthetic or natural diamond segments or particles adjacent the bottom of the borehole.

In order to provide a rotating cutter element sturdy enough to withstand downhole conditions yet be capable of slowly precessing the cutter, a cutting disc is rotated on a journal that is supported by a pair of journal blocks. Such a structure provides for a larger diameter cutting disc causing slower rotation and consequent longer life. This arrangement also permits selectability of the role of the cutter disc to provide for compressive or shear cutting forces on the formation.

BRIEF DESCRIPTION OF THE DRAWINGS

Other objects and many of the attendant advantages of this invention will be readily appreciated as the same becomes better understood by reference to the following detailed description when considered in conjunction with the accompanying drawings in which like reference numerals, designate like parts throughout the figures thereof and, wherein:

FIG. 1 is a perspective of a rock bit having cutters structured to rotate;

FIG. 2 is a perspective of the rear of one of the cutter elements from the rock bit of FIG. 1;

FIG. 3 is a cross section along 3—3 of FIG. 2;

FIG. 4 is a top plan view of a cutter and its placement on the head of the rock bit;

Figure 5:
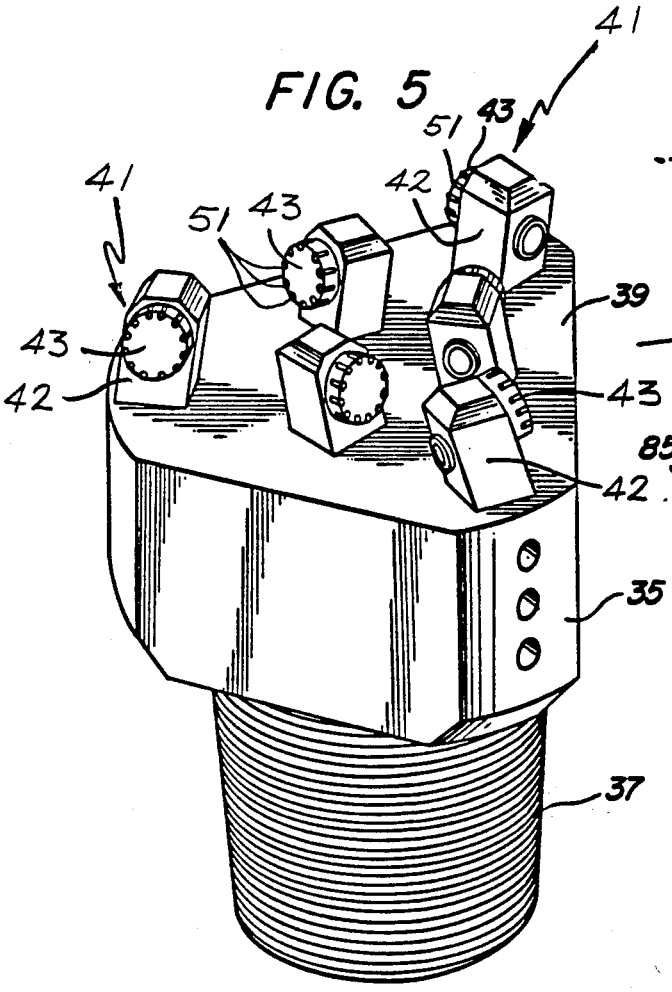
FIG. 5 is a perspective of a rock bit having a preferred embodiment of cutters structured according to the present invention.

DESCRIPTION OF THE PREFERRED EMBODIMENTS AND BEST MODE FOR CARRYING OUT THE INVENTION

Referring first to FIG. 1, a drag bit, generally designated as 11, is modified to accommodate the cutter elements of the present invention. Drag bit 11 consists essentially of body 15 having a cutter face end 17 and a pin end 13. The pin end 13 is the shank of the bit that connects to a drill string for rotation (not shown). Although FIG. 1 illustrates cutter face end 17 in an upward direction from the pin end 13, it will be understood by all those skilled in the art that the face end, when in the hole will be in a downward direction from pin end 13. The reader should bear this in mind as he follows through the descriptive portion of this patent specification.

Mounted on the cutter face 17 of bit 15 is a plurality of cutter elements, generally designated as 19, which generally lie on radial lines extending from the center of the face 17 of the drag bit 15. Each of the cutter elements 19 are comprised of an insert base or saddle 21 and a cutter segment 22.

The insert base 21 is preferably a tungsten carbide block having an aperture 24 therethrough (FIG. 3). The base of the saddle 21 is preferably keyed with a slot 27 which fits into an aperture and mating key formed in the face 17 of the drill bit. The saddle 21 may be press or interference fitted into an aperture formed in the face or may be fastened by brazing or some other convenient fastening means.

The cutter segment 22 is rotatably mounted within the aperture 24 of the saddle 21. The structure of the cutter element 19 preferably comprises a support crank 25, which rotates within the journal aperture 24, bearing primarily against conical surface 24', formed on the end of the crank 25. The end of the crank 25 supports cutter element 22 mounted thereon. The crank 25 is contained within saddle block 21 by a keeper sleeve 23 tapered as shown in FIG. 3. The keeper is, for example, brazed onto the shaft of crank 25 to maintain the crank and cutter in place within the saddle.

As shown in FIG. 3, which is cross section along 3—3 of FIG. 2, the saddle 21 has an aperture 24 therethrough which is a journaled bearing for the crank 25. The aperture 24 is tapered at both ends (12 and 14) in a manner which provides for both a rotary bearing and a thrust bearing surface. Tapered end 14 may support, for example, a conically shaped bearing sleeve 30. The sleeve may be fabricated from but not limited to, for example, aluminum bronze, copper alloys or a spinodal alloy, all of which are suitable bearing materials.

Moreover, all of the bearing surfaces 12, 14 and 24 may be lined with a sleeve of bearing material as set forth above (not shown).

In a preferred embodiment, the cutter element 22 consists of a wafer of synthetic diamonds such as described in U.S. Pat. No. 4,253,533, for example. As shown in FIG. 3, the cutting wafer 22 is at a negative rake angle "A" which is the result of the face 28 of saddle 21 being slanted as shown. This negative rate angle creates a compressive cutting force against the bottom 16 of the borehole which tends to crush more than slice away the earth formation.

The saddle 21 of each of the cutter elements 19 is mounted on face 17 of bit 11 along a radial line 32 (FIG. 4). The vertical center 20 of cutting face 22 intersects the circumferential movement arc 31 and the perpendicular plane 29. However, the cutting face 22 does not lie on a plane that is parallel to the radius 32. It is, instead, skewed at an offset angle 33 from the radius 32. This skew angle preferably is at a significant angle. The skew of the cutter wheels on the drill bit can be characterized in either of two ways. One is by the extent of offset of the cutting wheel from a radius parallel to the cutting face of the wheel. Alternatively, a skew angle can be defined between the axis of rotation of the cutting wheel and a tangent at a radius through the cutting wheel.

The acceptable minimum offset or angle of skew is sufficient to assure rotation of the cutter wheel as the drill bit is rotated. This is a function of the distance of the cutter wheel from the centerline of the drill bit, the diameter of the cutter wheel, and coefficients of friction. The coefficients of friction include the friction between the cutter and the rock formation being drilled, which to some extent depends on rock properties. It is also a function of the frictional forces in the bearings supporting the cutter.

The maximum offset or skew angle is when there is excessive rolling engagement of the cutter with the rock formation, as compared with scraping of the rock. The diamonds on the drag bit cut by scraping and not by crushing as is the case in the roller cone type of rock bit. Thus, it is important that the cutter wheels do not simply roll on the rock. The concept is to scrape the rock and provide enough rotation to renew the scraping face on the cutter.

It is preferred that the skew angle between the axis of rotation of the cutter and the tangent to a radius through the cutter be in the range of from ten degrees to sixty degrees. If the skew angle is less than ten degrees, there may not be assured rotation of the cutter, particularly as the cutter supporting bearings become worn. If the skew angle is greater than sixty degrees, the degree of scraping is reduced so that penetration rate is adversely affected.

Preferably, the skew angle between the axis of rotation of the cutter and a tangent to a radius through the cutter is in the range of from twenty degrees to thirty degrees. Within this range there is assured rotation of the cutters in response to engagement with most types of rocks encountered in well drilling. There is also a high degree of scraping of the rock formation to achieve high penetration rates.

To be more specific, the amount of skew is chosen on the basis of the speed at which the cutting face is to rotate. The smaller the angle of skew, the slower the rotation of cutting element 22. Whether the cutting element 22 turns clockwise or counterclockwise is a matter of choice. The important limit is that it is skewed from the radius of plane 32, causing tangential forces to be exerted on the cutting element 22 as a result of the rotation of the drill face 17 which rotates the crank or body 25 of the cutter to rotate within the journal 24 in the saddle 21 (FIG. 3).

As a result of this rotation, a continually new diametrical portion of cutting element 22 is exposed to the earth formation being scraped away thereby helping to keep the cutting element 22, which is preferably synthetic diamond, cool and relatively clear of debris. Keeping this cutting element 22 cool prolongs the life of the cutting wafer a substantial amount, thereby creating a more effective drag bit with a considerably extended life span. As is well known, diamond subjected to extended periods of high heat concentration will cause the diamond to disintegrate thus continual movement minimizes heat concentration on the cutting edge of element 22.

Referring now to FIG. 5 which illustrates a preferred embodiment for the cutter elements according to the present invention, a drag bit 35 is shown having a bit face 39 at the end opposite threaded pin end 37. The cutting elements, generally designated as 41, are as effective as the cutting elements 19 shown in FIG. 1. They have cutting face 43 at one end of the journal, a saddle 42 and a keeper 45 at the other end of the journal. Each of the elements are mounted along a radial line which extends from the center of the face 39 of the drag bit 35 (not shown). The face 43 is not covered with a cutting material. Only the circumference of the face 43 has a cutting material 51 equidistantly spaced and inserted therein (FIG. 6).

Figure 6:
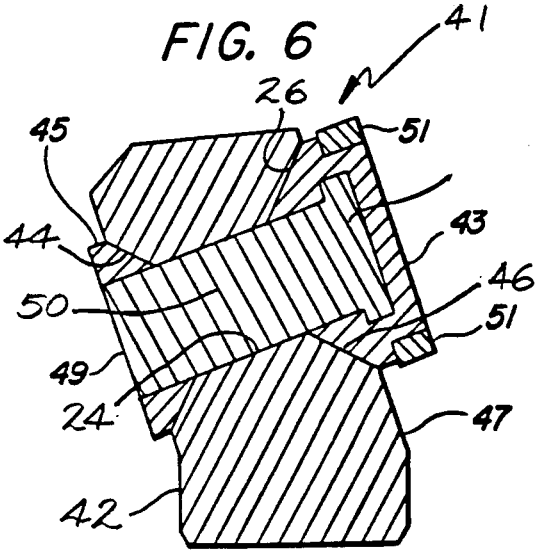
FIG. 6 is a cross section of one of the cutter elements shown in FIG. 5.

As can be seen in FIG. 6, a saddle 42 has a slanting face 47 with a journal 24 therethrough which is slanted (44 and 46) at the face and backsides to provide both thrust and rotary bearing surfaces. The crank 49 is constructed differently than the crank 25 of FIG. 3 in that it is composed of a series of parts. The first part is a shaft 50 which provides a rotary bearing surface 26, preferably of tungsten carbide material which is cast at end 48 of shaft 50 into cutting face 43, also preferably of tungsten carbide material. The face 43 has attached around its perimeter a plurality of equidistantly spaced cutter segments 51 of polycrystalline diamond cutting elements, for example, which are fastened directly into the matrix of the cutting end 43. The other end of the shaft 50 has brazed thereon a shaft keeper element 45. The cutting element, as shown in FIG. 6, provides for compressive cutting forces primarily due to the negative rake angle as shown with respect to FIG. 3.

Figure 7:
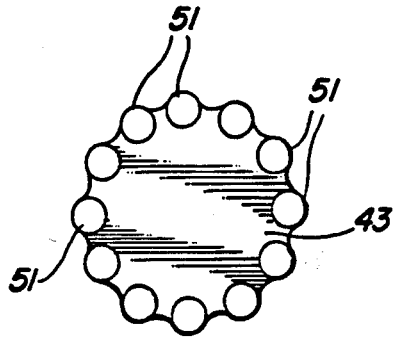
FIG. 7 is a plan frontal view of an alternate embodiment of a cutting disc according to the present invention.
Figure 8:
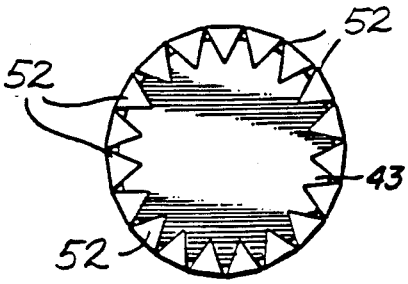
FIG. 8 is a plan frontal view of an alternate cutting disc according to the present invention.

Referring now to FIGS. 7 and 8, alternate configurations for the cutting face 43 are illustrated. Primarily what is shown is that the particular structure for the individual cutting segments 51, mounted along the circumference of the cutting face 43, need not be cylindrical. FIG. 7 shows cylindrical inserts 51. FIG. 8 shows triangular prisms 52 inserted into the circumference of the cutting face 43. Other shapes could also be used as desired. In addition, for example, these cutting segments are spaced so that the entire circumference of the cutting face is covered by the cutting segment material.

Figure 9:
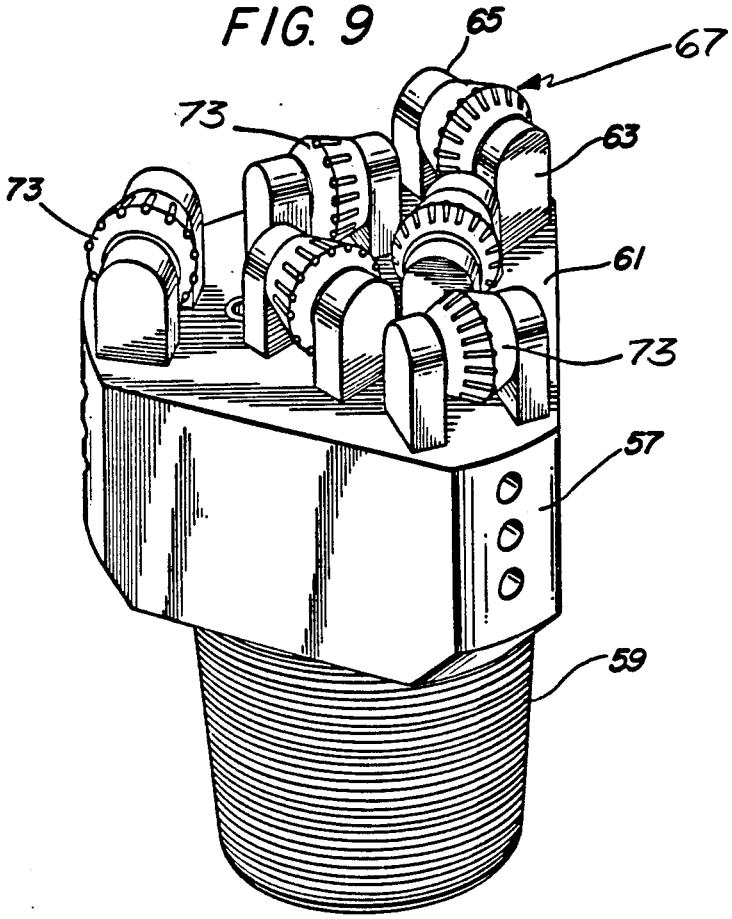
FIG. 9 is a perspective of a rock bit showing an alternate preferred embodiment of cutter elements according to the present invention.
Figure 10:
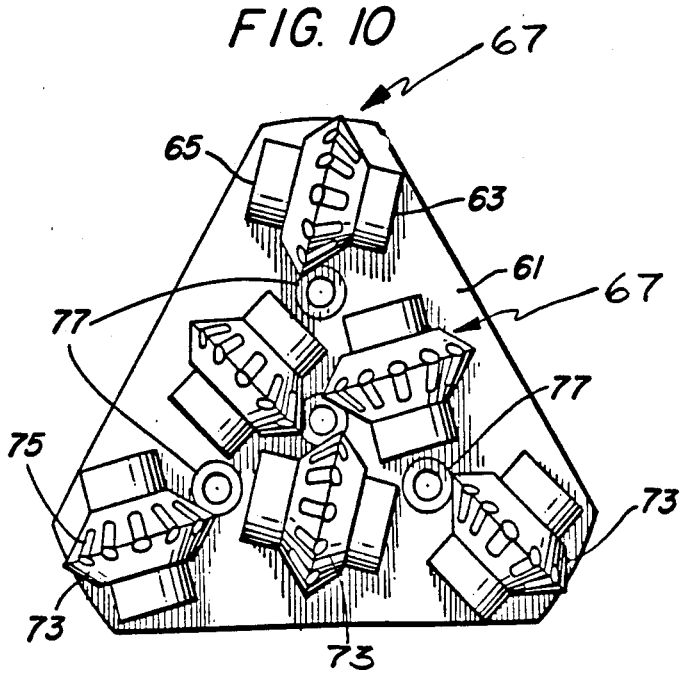
FIG. 10 is a top view of the drag bit head showing placement of cutter elements according to the present invention.
Figure 11:
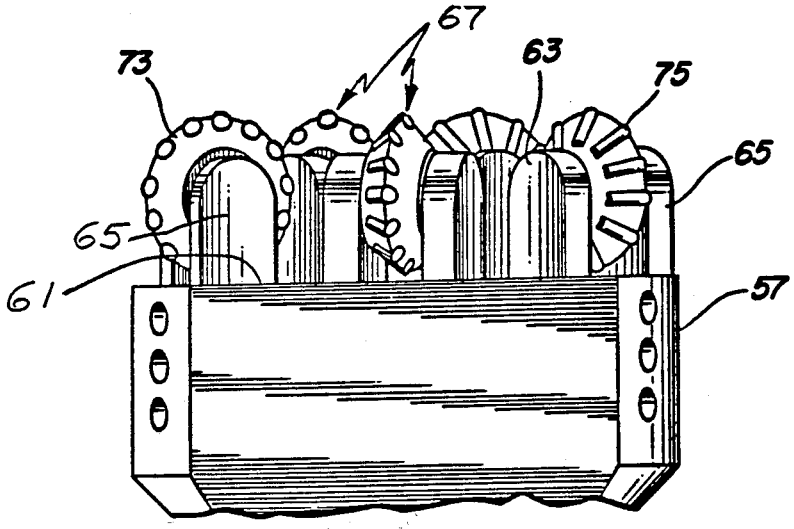
FIG. 11 is a side perspective of the drag bit and cutter elements shown in FIG. 10.

Referring now to FIGS. 9, 10 and 11, other alternate preferred embodiments of the cutters built according to the present invention for use in a drag bit 57 are illustrated. Drag bit 57 has a face 61 opposite to pin end 59. Mounted on face 61 is a plurality of cutter elements 67 mounted for rotation about a shaft rotatively secured to journal blocks 63 and 65. The cutting face 73 of the cutter 67 is skewed from a radius extending from the center of the face 61 of the drag bit 57, as more clearly shown in FIG. 10. The desired skew angle of cutting face 73 on each of the cutters 67 is skewed in the same manner as the cutting face 22 of cutting element 19 (FIG. 4). FIG. 10 also illustrates fluid nozzles 77 located in the face 61 of drill bit 57 which causes drilling fluid to be washed across the cutting elements 73 to cool and clean them as they precess during operation of the bit in a borehole.

Figure 12:
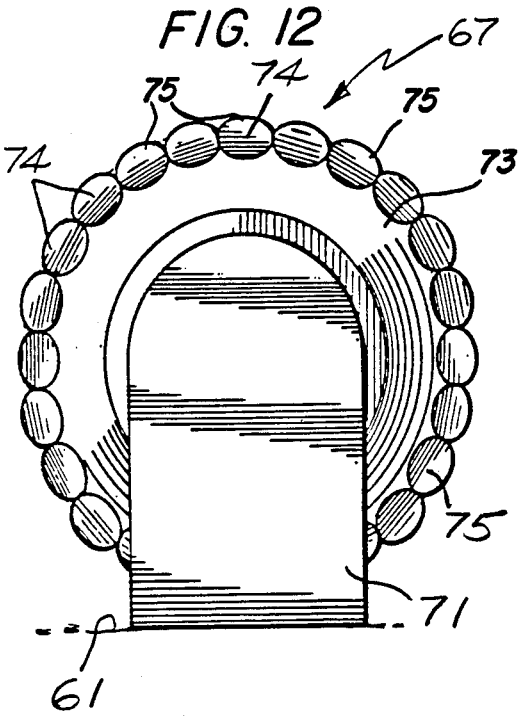
FIG. 12 is a side plan view of a cutter element that could be used in FIGS. 9, 10 and 11.
Figure 13:
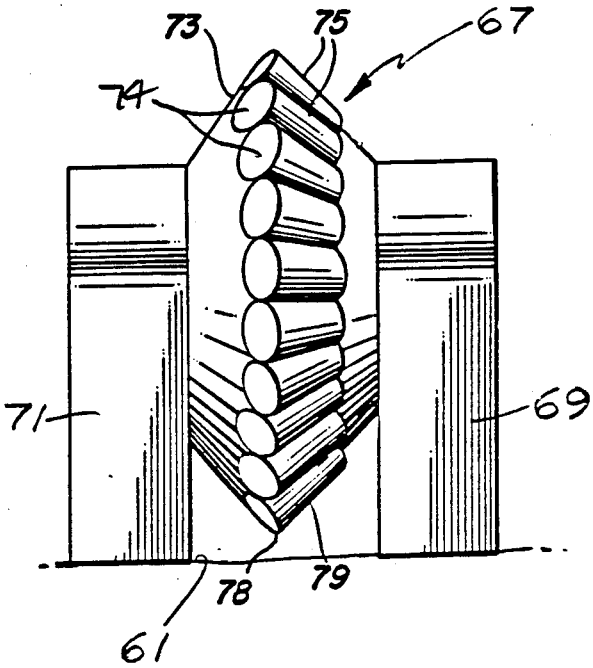
FIG. 13 is an end view of the cutter element shown in FIG. 12.

Referring now to FIGS. 12 and 13, an alternate structure for cutting elements 67 is illustrated. FIG. 12 illustrates the cutting face 73 of the cutter 67 which has a plurality of circular shaped cylinders 75 embedded around its perimeter in the manner shown. End 74 of cylinders 75 serves as the cutting face for cutter 67. The cutter 67 is mounted to a pair of bearing blocks 69 and 71 which provide both a thrust and a rotary bearing surface (not shown). The cutter 67 rotates around the shaft which is held by bearing blocks 69 and 72. The shaft may either be journaled into bearing block 69 and 71 or may be fixedly attached into bearing block 69 and 71 with the cutter elements 67 rotating around the fixed shaft. The latter arrangement is preferred.

The cutter 67 comes to an apex 78 which is on a plane passing through the geometric center of the cutter 67. The sloped surfaces 73 and 74 are part of a truncated conical section that slopes away from the apex 78. One end 74 of the cylinder cutting members 75 are mounted into and exposed at the cutting face side 73 while a small portion of the side of the cylinders 75 are exposed at the opposite side 79. Rotation of the cutter 67 causes different cutting cylinders 75 to come into contact with the formation being gouged away as the drill bit head rotates.

The cutter 67 is preferably of tungsten carbide. The cylindrical shaped cutter elements 75 are preferably of synthetic diamond which are held fast in the matrix of the tungsten carbide cutter structure 67. The mounting or bearing block 69, 71 are also preferably of tungsten carbide or similar high strength material held fast to the face 61 of drill bit 57, either by press fit or some other well known technique, such as brazing for example.

Figure 14:
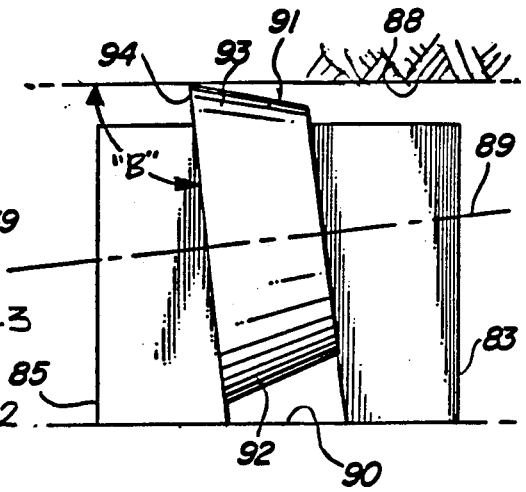
FIG. 14 is a side plan view of an alternate preferred embodiment showing an alternate mounting for a disc cutter element according to the present invention.

Refer now to FIG. 14. Another alternate preferred embodiment of a cutter element according to the present invention is illustrated. This embodiment is constructed to provide a positive rake angle "B" thereby providing true shear forces for slicing away the earth formation 88. A pair of bearing blocks 85 and 83 are utilized and are fastened to the bit face 90. Mounted for rotation with these bearing blocks is a truncated cone shaped cutter 92 having a cutting face 94 which is the base of the cone. The sides of the cone 91 are sloped at an angle 93 that is less than ninety degrees. The axis of rotation 89 of the cone cutter 92 is at an angle to the face 90 of the drill bit, creating a positive rake angle "B" with respect to the earth formation 88. The cone cutter 92 rotates about the axis of rotation as explained above. The journal blocks 85 and 83 are shaped to provide for both thrust and rotary bearing surfaces. The cone cutter 92 is preferably constructed of a hard material such as tungsten carbide. In the alternative, cutter elements may be located along its circumference in the manner illustrated for the embodiments of FIGS. 7–13.

Figure 15:
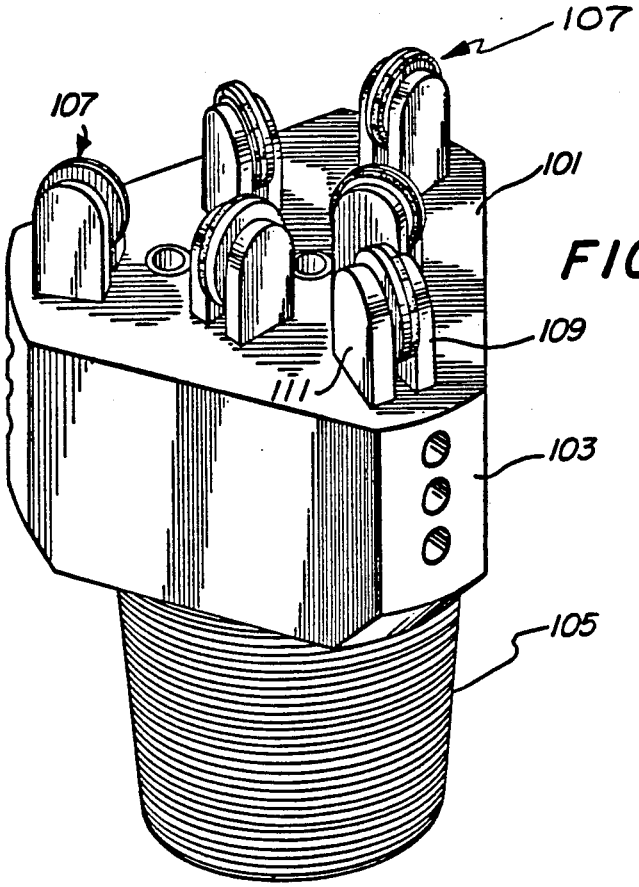
FIG. 15 is a perspective of a rock bit showing an alternate preferred embodiment of cutter elements according to the present invention.
Figure 16:
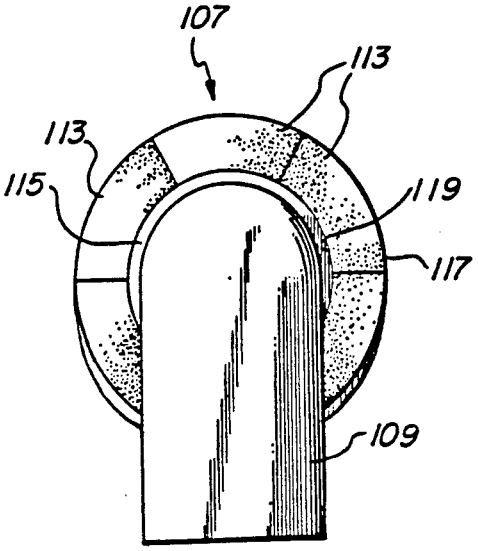
FIG. 16 is a side plan view of a cutter element used in the rock bit of FIG. 15.
Figure 17:
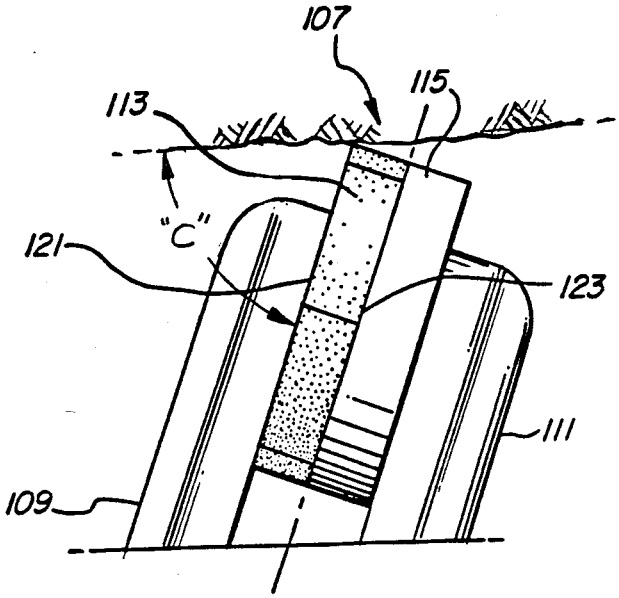
FIG. 17 is an end view of the cutter element of FIG. 16.

Referring now to FIGS. 15, 16 and 17, an alternate preferred embodiment of a drag bit with cutter elements according to the present invention is illustrated. Drag bit 103 has a face 101 opposite pin end 105. Mounted on the face 101 is a plurality of disc shaped cutters, generally designated as 107, each mounted to a pair of journal blocks 109 and 111. The orientation of the cutting faces 112 of cutter elements 113 of cutters 107 is the same as the orientation of the cutters shown in FIGS. 9, 10 and 11.

Figure 18:
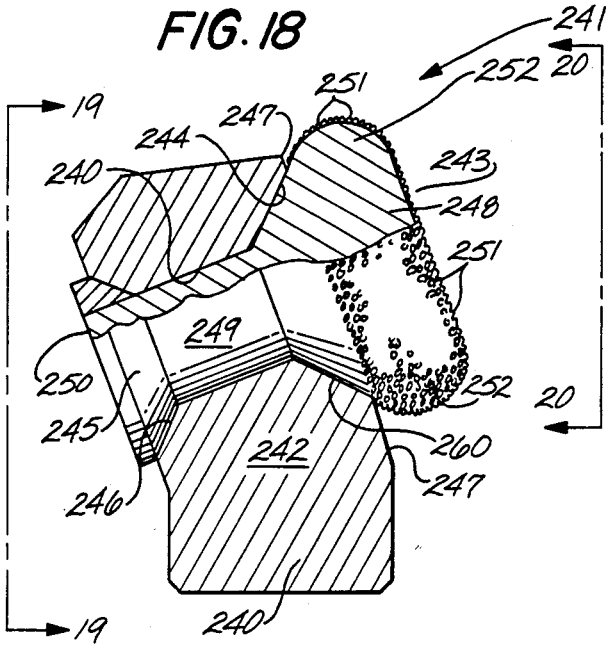
FIG. 18 is a side plan view, partially broken away, of another embodiment of a cutter element.
Figure 19:
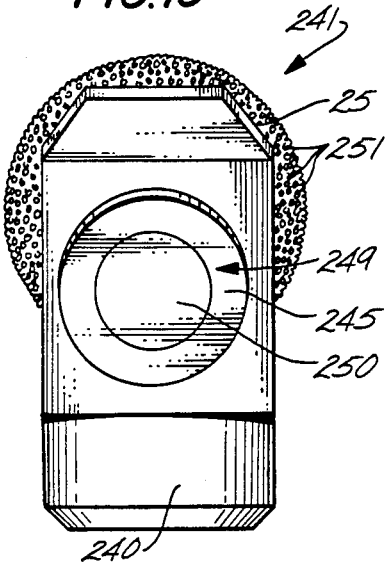
FIG. 19 is an end view of the cutter element of FIG. 18.
Figure 20:
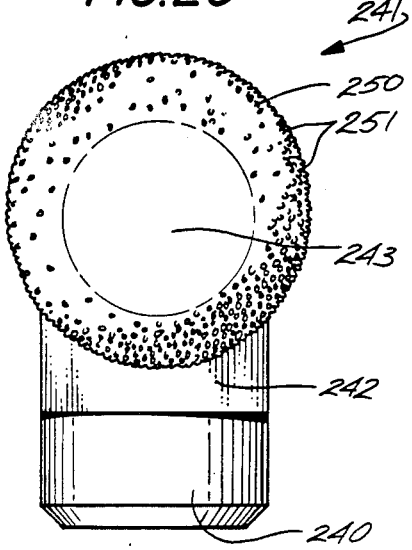
FIG. 20 is a front view of the cutter element of FIG. 18.

The cutter elements 113 mounted in the cylindrical cutter 115 is an arcuate segment that is, for example, three-quarters of an inch between radial sides 117 and 119. The inlaid segments 113 are approximately five-eighths of an inch thick. The diameter of the cylinder 115 for this size of cutting segment is preferably four inches. The material variations of the cutter elements 113, the cylindrical cutter 115 and the mounting blocks 109 and 111 are explained above. The cutting face 113 of the disc shaped cutter 107 is preferably mounted at a negative rake angle "C" of up to forty-five degrees from the perpendicular to the face 101 of the drag bit in certain situations. Referring now to FIGS. 18, 19 and 20, which illustrate another embodiment for the cutter elements according to the present invention. The cutting elements, generally designated as 241, are effective in particularly hard formations. This particular embodiment has a toroidally shaped cutting surface 243 at one end of the journal generally designated as 249. A saddle 242 is provided for journal 249 which provides a bearing surface 240 thereby. A journal keeper 245 is provided at end 250 of journal 249. At the opposite end of journal 249 is cutter end 243, the peripheral edge of which is rounded or toroidally shaped at periphery 252. The back side 260 of cutter end 243 is conically shaped and provides a bearing surface which mates against a complementary conical mating surface 244 in saddle 242. Bearing sleeves may be provided as set forth relative to FIG. 3. The conical surfaces 260 and 244 serve to take the brunt of the thrust from the rotating cutter head 243 during operation of the cutter in a borehole. Similar conically shaped bearing surface 246 formed in saddle 242 is provided having complementary surfaces on the keeper 245 which retains the rotating cutter within the saddle 242. The rounded toroid surface 252 of cutter end 248 of the shaft 249 is covered with embedded natural or synthetic diamonds 251, or other hard materials. These hard materials are mechanically fixed within a matrix of, for example, tungsten carbide applied to the end 248 of the shaft 249. This process is well known within the art. The multiplicity of natural or synthetic diamonds 251 covering the rounded peripheral edge 252 are particularly effective in hard formations as previously indicated. The cutter elements 241 are skewed from the radius of a plane as previously described which causes rotational forces to be exerted on the cutter elements 243.

As stated before, a continually new diametrical portion of the cutter element 241 is exposed to the earth formation being abraded away thereby helping to keep the cutter elements 241 cool and clear of debris. The multiplicity of natural or synthetic diamond chips 251 are vulnerable to heat as are the foregoing cutter elements, hence continual rotation of the cutter head 243 within its saddle block 242 is important to maintain the integrity of the diamonds on cutter end 243.

FIG. 19 illustrates the rear side of the cutter elements 241 showing the multiplicity of natural or synthetic diamonds 251 completely covering the rounded toroid surface 252 of end 243.

FIG. 20 illustrates a front face view of the cutter element 241 showing the outer toroidally shaped surface 252 covered with natural diamonds 251. The center portion of the cutter end 243 is free of diamond cutter segments since it does not significantly contact any of the formation.

The end 240 of saddle 242 is preferably interference fitted within a hole formed in the face of a drag bit as previously described (not shown).

Figure 21:
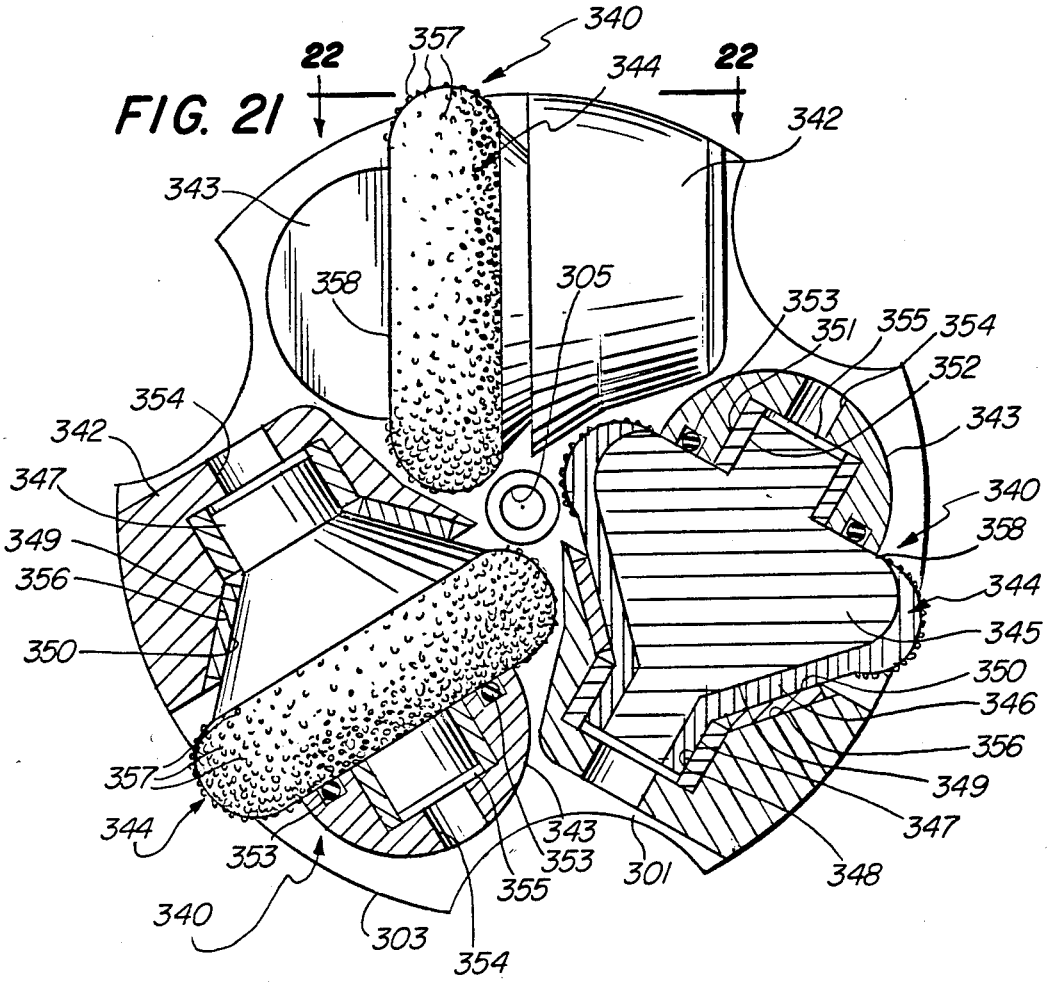
FIG. 21 is an end view of three cutter elements of yet another embodiment, some of which are partially in cross section.

FIG. 21 illustrates yet another preferred embodiment of the present invention. A cutter assembly 340 consists of a torus cutter, generally designated as 344. Cutter 344 is similar to the cutter described with respect to FIG. 18, 19 and 20 with the following exception. A steel core body 345, for example, forms a bearing shaft or journal 343 ahead of the torus cutter head 349 as well as a journal 347 behind torus 349. The pair of axially aligned shafts 353 and 347 are supported by journal bearings 348 amd 352 formed by saddles or cradles 342 and 343. Saddle 342 additionally forms a conical surface 356 to support conical bearing 350. The bearings 348, 350 and 352 may be fabricated of bearing materials heretofore described. The conical bearing formed by the cutter 344 is part of a matrix of tungsten carbide 346 that takes its initial shape in a mold. The central steel body 345 is concentrically positioned in the mold and the powder metal, tungsten carbide matrix is formed and bonded to the body 345 within the mold. A multiplicity of synthetic or natural diamond cutter chips 357 are randomly positioned in the peripheral torus surface and mechanically held fast in the matrix of tungsten carbide. The face 358 of the steel core is exposed circumferentially with the torus ring of diamond cutter chips 357, the matrix of tungsten carbide being formed aft of face 358.

The rotary cutter 344 may be urged or biased against conical bearing surface 350 by cutter biasing means 353. The biasing means may be a spring or a resilient O-ring for such biasing purposes.

Figure 22:
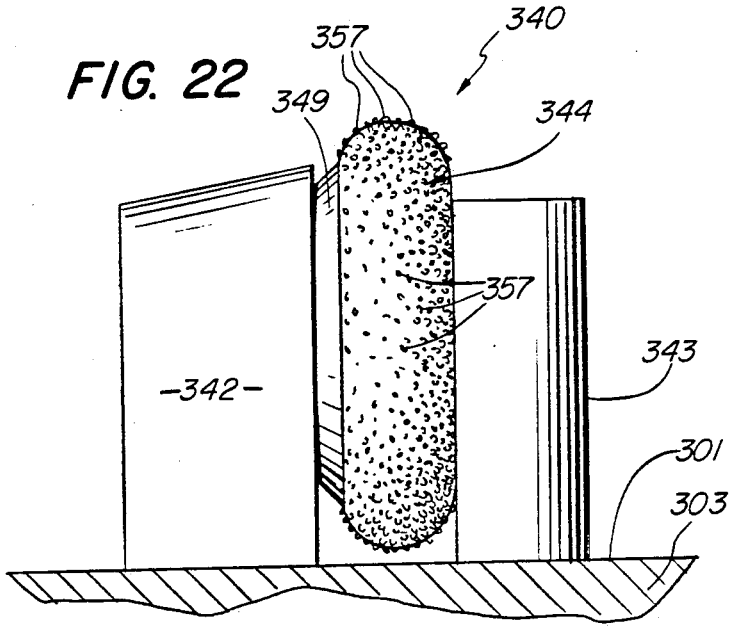
FIG. 22 is a view taken through 22—22 of FIG. 21.

FIG. 22 illustrates the torus cutter 344 rotatively mounted to saddles 342 and 343. The diamond covered torus wheel 344 is, for example, mounted with its axis of rotation substantially parallel to face 301 of bit body 303 with essentially no negative or positive rake angle.

An exemplary drill bit constructed according to principles of this invention has three four inch diameter wheels 344 mounted so that the outside edges of the wheels are on an 8½ inch diameter. That is, as the bit is used it drills a hole having a diameter of 8½ inch. The four inch wheels 344 would accommodate bits from 7½ to 9 inches in diameter. Each wheel is offset one inch in the forward direction of rotation of the drill bit from a radius perpendicular to the axis of rotation of the cutter wheel. The cutting face of each wheel is roughly toroidal with the minor axis of the torus having a radius of ¾ inch. In such an embodiment, when cutting in a test block of granite the cutter wheels rotate at about one-tenth the rate of rotation of the drill bit. That is, each disc rotates one revolution for every ten revolutions of the drill bit. Put another way, the cutter wheel should be offset from the radius of the bit body a sufficient distance that the cutter wheel rotates in the range of from one-twentieth to one-half revolution for every revolution of the drag bit in a borehole. This proportion of rotation is approximate since it depends in part on the rock and bearing frictional characteristics as well as the geometry.

A roughly toroidal cutting face on the wheel is preferred for at least the innermost cutter wheels on a drill bit because cutting does not occur solely at the maximum diameter of the wheel. Some of the cutting is forward of the maximum diameter of the wheel, and near the center of the drill bit some of the cutting action is behind the maximum diameter. An axial core less than about one inch in diameter is left in the center of the hole being drilled and intermittently breaks off as drilling progresses. A conventional core breaker in the drill bit body can be used if desired (not shown).

In the embodiment of FIG. 21 three cutter wheels 344 with approximately toroidal cross sections of the cutting face are used adjacent the core and also to cut at the full gage of the hole. In a larger diameter bit a mix of wheel types may be employed. Thus, for example, three cutter wheels 344 with a toroidal cutting face may be used near the core and cutter wheels with cross sections as described and illustrated in FIGS. 21 and 22 used adjacent the core and also to cut at the full gage of the hole. In a larger diameter bit a mix of wheel types may be employed. Thus, for example, three cutter wheels with a toroidal cutting face may be used near the core and cutter wheels with cross sections as described and illustrated in FIGS. 3, 7, 8 or 17 may be used nearer the gage.

Moreover, the bit in our example above may have one or more nozzles or apertures 305 communicating between a fluid plenum (not shown) formed by the bit and each of the rotary cutters mounted to the bit face.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A rotary drag bit for drilling wells, comprising:

a bit body rotatable about a central axis adapted to be secured to a drill column, said bit body having a face opposite to the drill column connection; and a plurality of insert cutters mounted in said face along respective radial lines emanating from said central axis and on respective circumferences of said central axis, each insert cutter comprising:

a mounting block of high strength material with a bearing mounted through its face at the end opposite the end mounted in the face of the bit body, an axis of said bearing is skewed at an angle to its radial line in the plane of the bit body face; and a diamond cutter element with journal means mounted for rotation in said bearing, said cutter element having a plurality of diamond cutting segments embedded in its circumference.

2. The invention as set forth in claim 1 wherein said mounting block is skewed so the side nearest the central axis of rotation extends past the radial line for that mounting block.

3. The invention as set forth in claim 1 wherein said bearing in said mounting block is at an angle to the face of said bit body.

4. The invention as set forth in claim 3 wherein said angle of said bearing to said mounting block is a positive angle creating shear forces when in the hole.

5. The invention as set forth in claim 3 wherein said angle of said bearing to said mounting block is a negative angle creating compression forces when in the hole.

6. The invention as set forth in claim 1 wherein the cutting segment of said cutter element with journal means comprises diamond segments mounted in a tungsten carbide base having a stud for rotation within said bearing.

7. The invention as set forth in claim 6 wherein said tungsten carbide base is tapered to fit within a complementary tapered rotary recess formed in the face of said mounting block.

8. The invention as set forth in claim 6 further comprising a sleeve brazed on the end of the stud opposite the diamond wafer extending through said bearing in said mounting block.

9. The invention as set forth in claim 7 wherein said sleeve is tapered to fit within a rotary recess in said mounting block opposite its face.

10. The invention as set forth in claim 6 wherein said diamond segments are generally cylindrical with one end and a portion of one side exposed.

11. The invention as set forth in claim 6 wherein said diamond segments are generally triangular shaped prisms with one end and one apex exposed.

12. The invention as set forth in claim 1 wherein said cutter element with journal means comprises a generally circular tungsten carbide matrix with diamond chips spaced along the circumference thereof.

13. The invention as set forth in claim 12 wherein said circular tungsten carbide matrix is attached to a stud that rotatably fits into said bearing in said mounting block.

14. The invention as set forth in claim 13 wherein the tungsten carbide matrix is tapered to fit within a mating recess in the face of said mounting block.

15. The invention as set forth in claim 13 further comprising a sleeve brazed on the end of the stud opposite said circular tungsten carbide matrix extending through said bearing in said mounting block.

16. The invention as set forth in claim 15 wherein said sleeve is tapered to fit within a mating recess in said mounting block opposite its face.

17. The invention as set forth in claim 1 wherein said mounting block comprises a pair of bearing blocks, each block supporting an opposite end of a shaft, said mounting block mounted in the face of the bit for receiving said shaft.

18. The invention as set forth in claim 17 wherein said cutter element with journal means comprises a tungsten carbide generally disc shaped cutter arranged for rotation about the shaft.

19. The invention as set forth in claim 18 wherein diamond chips are mounted in the perimeter of the tungsten carbide disc.

20. The invention as set forth in claim 19 wherein said diamond chips comprise elongated diamond members embedded in a tungsten carbide matrix in spaced relationship around its perimeter, with one end and part of one side exposed.

21. The invention as set forth in claim 18 wherein an axis of rotation of said shaft supported by said bearing blocks is skewed, the respective sides nearest the central axis of rotation extending past the radial line for each pair of bearing blocks.

22. The invention as set forth in claim 18 wherein said bearings in said pair of mounting blocks are parallel to the face of the rotary drag bit.

23. The invention as set forth in claim 18 wherein said bearings in said pair of mounting blocks are on the same axis of rotation at an angle to the face of the rotary drag bit.

24. The invention as set forth in claim 23 wherein said angle of said bearing with said face is a positive angle thereby creating shear forces when in the hole.

25. The invention as set forth in claim 23 wherein said angle of said bearings with said face is a negative angle thereby creating compressive forces when in the hole.

26. A rotary drag bit for drilling wells comprising:

a bit body rotatable about a central axis adapted to be secured to a drill column, said bit body having a face opposite to the drill column connection; and a plurality of insert cutters mounted in said face along respective radial lines emanating from said central axis and on respective circumferences of said central axis, each insert cutter comprising:

a pair of bearing blocks, each block having a bearing extending from its face at the end opposite the end mounted in the face of the bit, said pair of bearing blocks being aligned in parallel, an axis of said bearing in said bearing blocks is skewed at an angle to its radial line in the plane of the bit body face; and a truncated cone shaped cutter element mounted for rotation about a shaft mounted in each bearing, the base of the cone facing the direction of rotation of the bit.

27. The invention as set forth in claim 26 wherein the axis of rotation of the shaft is at a positive angle with respect to the face of the bit, thereby creating shear forces when in the hole.

28. The invention as set forth in claim 26 wherein diamond chips are mounted in the perimeter of the cutter element.

29. The invention as set forth in claim 28 wherein said diamond chips comprise elongated diamond members embedded in a tungsten carbide matrix in spaced relationship around its perimeter.

30. A rotary drag bit for drilling wells, comprising:

a bit body rotatable about a central axis adapted to be secured to a drill column, said bit body having a face opposite to the drill column connection; and a plurality of insert cutters mounted in said face along radial lines emanating from said central axis, each insert cutter comprising:

a mounting block of high strength material with a bearing through its face at the end opposite the end mounted in the face of the bit body, an axis of said bearing is skewed at an angle to its radial line; and a cutter element having a first cutting end and a second base end with journal means formed therebetween mounted for rotation in said bearing, said cutter element, at said first cutting end, forms a rounded, toroidally shaped peripheral edge, said rounded edge having a multiplicity of cutting segments embedded in at least its toroid surface.

31. The invention as set forth in claim 30 wherein said mounting block is skewed so the side nearest the central axis of rotation extends past the radial line for that mounting block.

32. The invention as set forth in claim 30 wherein said bearing in said mounting block is at an angle to the face of said bit body.

33. The invention as set forth in claim 32 wherein said angle of said bearing to said mounting block is a negative angle thereby creating compression forces when in the hole.

34. The invention as set forth in claim 30 wherein the first cutting end of said cutter element with journal means comprises a tungsten carbide base forming a means for rotation within said bearing.

35. The invention as set forth in claim 34 wherein said means for rotation of said tungsten carbide base is a tapered surface formed by said base to fit within a complementary rotary recess formed in the face of the mounting block.

36. The invention as set forth in claim 30 wherein said cutter element at said first cutting end comprises a toroidally shaped tungsten carbide matrix with a multiplicity of diamond chips spaced along and embedded in the toroidal circumference thereof.

37. The invention as set forth in claim 36 wherein said circular tungsten carbide matrix is attached to a stud that rotatably fits into said bearing in the mounting block.

38. The invention as set forth in claim 37 wherein the tungsten carbide matrix is tapered to fit within a mating recess in the face of the mounting block.

39. The invention as set forth in claim 30 wherein said cutting segments embedded in said toroidal surface are natural diamonds.

40. The invention as set forth in claim 30 wherein said cutting segments embedded in said toroidal surface are synthetic diamonds.

41. The invention as set forth in claim 30 wherein the axis of said bearing means is at an acute angle to the face of the bit body.

42. The invention as set forth in claim 41 wherein the axis of said bearing and journal means is skewed from ten to sixty degrees from said radial line.

43. A rotary drag bit for drilling wells comprising:

a bit body rotatable about a central axis and including means for connecting the bit body to a drill string, said bit body having a face opposite to the drill string connection; and a plurality of drag cutters mounted on said face along respective radial lines emanating from said central axis and at different respective distances from the central axis for collectively scraping formation across substantially the entire bottom of a borehole being drilled, each drag cutter comprising:

a mounting block with bearing means at the end remote from the face of the bit body; and a diamond cutter element with journal means mounted for rotation relative to said bearing means, said cutter element having a plurality of cutting segments embedded in a circumferential cutting face, the cutting face being skewed at an angle from a radial line from the central axis to the cutter element so that the cutter element precesses as the cutting face contacts the borehole formation.

44. The invention as set forth in claim 43 wherein the mounting block comprises a saddle supporting both ends of a shaft and the cutting element is mounted on the shaft between the ends supported by the saddle.

45. The invention as set forth in claim 43 wherein the shaft is parallel to the face of the bit body.

46. The invention as set forth in claim 43 wherein the bearing means comprises an aperture in the mounting block and the journal means comprises a shaft extending through the aperture, with the cutting face being at one end of the shaft.

47. The invention as set forth in claim 43 wherein the axis of said bearing means is at an acute angle to the face of the bit body.

48. A rotary drag bit for drilling wells comprising:

a bit body rotatable about a central axis and including means for connecting the bit body to a drill string, said bit body having a face opposite to the drill string connection;

a plurality of drag cutters mounted on said face along respective radial lines emanating from said central axis for collectively scraping formation across the bottom of a borehole being drilled, each drag cutter comprising:

a cutter wheel having a circumferentially extending external cutting face;

a plurality of diamond cutting segments embedded in the cutting face;

bearing means for rotatably supporting the cutting wheel; and means for mounting the bearing means on the bit body for rotation around an axis skewed from a tangent to a radius to a periphery of the wheel about ninety degrees from said axis of the wheel at an angle in the range of from ten degrees to sixty degrees.

49. A rotary drag bit as set forth in claim 48 wherein the skew angle is in the range of from twenty degrees to thirty degrees.

50. A rotary drag bit as set forth in claim 48 wherein the cutter wheel has a generally toroidal cutting face and the diamond cutting segments comprise a multiplicity of diamond crystals partially embedded in the toroidal face.

51. A rotary rock bit for drilling wells comprising:

a bit body rotatable about a central axis and including means for connecting the bit body to a drill string, said bit body having a face opposite to the drill string connection; and a plurality of drag cutters mounted on said face along respective radial lines emanating from said central axis for collectively scraping formation across the bottom of a borehole being drilled, each drag cutter comprising:

a cutter wheel having a circumferentially extending external cutting face;

a plurality of diamond cutting segments embedded in the cutting face;

bearing means for rotatably supporting the cutting wheels; and means for mounting the bearing means on the bit body for rotation around an axis normal to a radius of the bit body wherein a periphery of the wheel taken about ninety degrees from an axis of said wheel is offset from the radius of the bit body a sufficient distance to assure that the cutter wheel rotates due to tangential force on the cutter wheel as the drill bit is rotated around its axis on the bottom of a hole being drilled.

52. A rotary drag bit as set forth in claim 51 wherein the cutter wheel is offset from the radius a sufficient distance that the cutter wheel rotates in the range of from one-twentieth to one-half revolution for every revolution of the drag bit.

* * * * *